United States Patent [19]

Gilliams et al.

[11] 4,259,429

[45] Mar. 31, 1981

[54] PROTECTION OF TONER IMAGES

[75] Inventors: Yvan K. Gilliams, Berchem; Walter F. De Winter, 'a-Gravenwesel; Daniel M. Timmerman, Mortsel, all of Belgium

[73] Assignee: AGFA-GEVAERT N.V., Mortsel, Belgium

[21] Appl. No.: 67,210

[22] Filed: Aug. 16, 1979

Related U.S. Application Data

[63] Continuation of Ser. No. 886,751, Mar. 15, 1978, abandoned, which is a continuation of Ser. No. 564,137, Apr. 1, 1975, abandoned.

[30] Foreign Application Priority Data

Apr. 3, 1974 [GB] United Kingdom ..... 14803/74

[51] Int. Cl.[3] ..... G03G 13/10

[52] U.S. Cl. ..... 430/124; 427/14.1

[58] Field of Search ..... 430/33, 124; 427/14.1; 252/62.1 L

[56] References Cited

U.S. PATENT DOCUMENTS

| | | | |
|---|---|---|---|
| 3,157,546 | 11/1964 | Cover | 430/126 |
| 3,194,777 | 7/1965 | Christenson et al. | 260/33.6 UA |
| 3,242,144 | 3/1966 | McNally | 260/33.6 UA |
| 3,310,513 | 3/1967 | Barie et al. | 260/33.6 UA |
| 3,640,749 | 2/1972 | Lorenz | 427/411 |
| 3,669,859 | 6/1972 | Merrill | 430/124 |
| 3,753,760 | 8/1973 | Kosel | 252/62.1 L |
| 3,767,448 | 10/1973 | Hutton | 430/628 |
| 3,779,748 | 12/1973 | Mosehauser et al. | 430/8 |

FOREIGN PATENT DOCUMENTS

| | | | |
|---|---|---|---|
| 46-30031 | 9/1971 | Japan | 430/124 |
| 49-24293 | 6/1974 | Japan | 430/124 |

*Primary Examiner*—John H. Newsome
*Attorney, Agent, or Firm*—William J. Daniel

[57] ABSTRACT

A method of protecting a toner image on a resin-containing material surface comprising applying to the surface carrying the toner image a liquid fixing composition in which the liquid is a hydrocarbon liquid being mainly composed of (a) liquid aliphatic hydrocarbon(s) and which contains in dissolved form a film-forming copolymer composed of:

(A) monomers, of the group consisting of $C_1$–$C_5$ aliphatic esters of methacrylic acid and vinyltoluene, (B) monomers of the group consisting of $C_7$–$C_{24}$ aliphatic esters of methacrylic acid or acrylic acid and optionally (C) monomers of the group consisting of $C_1$–$C_5$ aliphatic esters of acrylic acid and vinyl esters of $C_1$–$C_{10}$ aliphatic acids.

15 Claims, No Drawings

PROTECTION OF TONER IMAGES

This is a continuation of Ser. No. 886,751, filed Mar. 15, 1978, which was a continuation of Ser. No. 564,137, filed Apr. 1, 1975, both now abandoned.

This invention relates to a method of protecting toner images and to compositions suited for the production of protected toner images.

Electrophotography and electrography are well-known imaging techniques wherein electrostatic charge patterns are made visible with finely divided electrostatically attractable material called "toner".

Historically, a one-component dry powder toner was first used for developing electrostatic images. Other development processes at present known as cascade, fur brush, powder cloud, magnetic brush and liquid electrophoretic development were introduced. A survey and description of these processes is given, e.g., by R. M. Schaffert in the book "Electrophotography", The Focal Press, London and New York (1965). In the same book a variety of electrophotographic, electrographic and magnetic printing processes using toner development are described.

Many of the powdered toners used in xerography consist primarily of fusible resins. When such toners are deposited on or transferred to a receptor paper sheet, the toner images can be fixed permanently by heating or by applying a solvent vapour, which partially dissolves the toner and causes it to fuse into the paper.

Developers of the electrophoretic type initially comprised basically a simple dispersion of a pigment and no binder was present. It was later proposed e.g by Metcalfe and Wright, in J. Oil Colour Chem. Ass. 39 (1956) 851–853, to use liquid developers incorporating a resin. The resultant images are then made of so-called "self-fixing" toners.

Electrophoretically formed toner images for which a liquid is used comprising dispersed toner particles are fixed by adhesion and absorption into paper supports and usually do not require additional fixing on said supports.

A problem of permanent adherence arises, however, when electrophoretically deposited toner particles have to be adhered to smooth non-porous supports, e.g. resin, metal or glass supports.

Even self-fixing toners do not adhere permanently to smooth surfaces and therefore the resultant toner images have to be fixed by a subsequent procedure.

One useful procedure for subsequent fixing of toner images is the application of a lacquer overcoat. Various procedures have been suggested for applying such a lacquer overcoat. In practice the lacquer is usually applied by spraying a resin solution on the toner image. Another method consists in the application of the resin solution by means of an applicator roller. The spraying technique requires a propellant gas or air under pressure, which makes the apparatus rather sophisticated. In addition there is often the problem of the spray nozzle being blocked when the apparatus is out of use.

Particularly disadvantageous in said applicator systems when applied in combination with electrophoretic development is the use of an aqueous resin fixer that is not compatible with the liquid carrier vehicle of the toner dispersion. Because of this incompatibility it is necessary to dry a liquid developed image prior to the application of the aqueous resin fixer.

Accordingly, there is a need for a method of fixing images developed by an electrophoretic toner, which method does not require any thorough previous drying of the developed image. The fixing layer has to have a good adhesion in respect of the toner and the smooth support, a high abrasion-resistance, a good flexibility, and transparency. It has also to be tack-free, in other words it must not show fingerprints after manual contact in a temperature range of about 20° to about 40° C.

It is an object of the present invention to provide a fixing composition for the protection of images developed by an electrophoretic toner, which composition is clean and forms a fixing layer having the above defined qualities, and which neither requires any thorough previous drying of the developed image, nor any special or sophisticated applicator means.

Said object is achieved by a fixing composition, which according to the invention contains an organic solvent that is compatible (miscible) with the solvent used as carrier liquid in the toner dispersion for the electrophoretic development and which contains a copolymer built up by monomers (A) that are capable of providing anti-abrasion properties and non-tackiness to the protective layer, and monomers (B) that are capable of imparting the necessary solubility in the organic solvent in a temperature range of 20° to 40° C. and optionally also flexibility to the protective layer.

When the combination of the above monomers (A) and (B) yields too brittle a copolymer, a third monomer (C monomers) is built-in in the copolymer structure mainly to act as a softening agent, thus improving the flexibility of the protective layer and yielding better film coating properties.

As can be learned from the examples the selection of the combination of the monomers (A) and (B) in many cases is such that the above requirements are fulfilled without use of a third monomer. It is self-explanatory that in view of the main characteristic of the fixing layer the final copolymer has to possess the required adherence towards the toner particles and the surface of the support to which the toner image is applied.

It has been discovered that when using a hydrocarbon liquid mainly consisting of (an) aliphatic hydrocarbon(s) as carrier liquid in the electrophoretic development, the fixing of the electrophoretically formed toner image on a resinous surface proceeds very well by applying to the surface carrying the toner image a liquid fixing composition in which the liquid is a hydrocarbon liquid being mainly composed of (a) liquid aliphatic hydrocarbon(s) and which contains in dissolved form a film-forming copolymer composed of:

(A) monomers of the group consisting of $C_1$–$C_5$ aliphatic esters of methacrylic acid, preferably methyl-, and/or iso-butyl- and/or n-butyl methacrylate, and vinyltoluene, preferably m-vinyltoluene and/or p-vinyltoluene, (B) monomers of the group consisting of $C_7$–$C_{24}$ aliphatic esters of methacrylic acid or acrylic acid, preferably lauryl- and/or heptylmethacrylate or docosyl- and tetracosyl acrylate.

The term "aliphatic" in connection with the hydrocarbon(s) of the liquid includes here paraffinic, isoparaffinic and cycloaliphatic hydrocarbons.

Optionally the copolymer contains monomers (C) that improve the flexibility of the protective fixing layer. They belong to the group consisting of $C_1$–$C_5$ aliphatic esters of acrylic acid e.g. ethyl and/or butyl acrylate and vinyl esters of $C_1$-$C_{10}$ aliphatic acids e.g. versatic acid.

The coated and dried protective fixing layer obtains its anti-abrasion properties and tackfree character mainly from the specified (A) monomers.

The specified (B) monomers offer the necessary solubility of the fixing copolymer in the hydrocarbon liquid in the range of 20° to 40° C. Therefore, these (B) monomers are preferably present in the copolymer in such an amount that the solubility of the copolymer in the hydrocarbon liquid is at least 2 g per 100 ml in the temperature range of about 20° to about 40° C.

In general, the monomers (A) and (B) mutually counteract the properties they provide to the copolymer. So, the antiabrasion properties are lowered by the monomers (B) and the solubility is lowered by the monomers (A). Therefore, by the choice of a useful fixing copolymer the optimization of the ratio of the monomers (A) with regard to monomers (B)—possibly combined with monomers (C)—is necessary to obtain the best compromise between solubility of the copolymer and the desired mechanical properties of the coated protective fixing layer.

Preferred copolymers contain from about 50 to about 90% by weight of (a) specified monomer(s) (A) and from about 10 to about 50% by weight of (a) monomer(s) (B). The content of monomer(s) (C) is optionally from 0 to about 20% by weight.

In order to illustrate the preparation of particularly suitable copolymers the following preparation recipes are given:

1. Preparation of copoly(isobutyl) methacrylate/n-lauryl methacrylate/methyl methacrylate) having the following structure

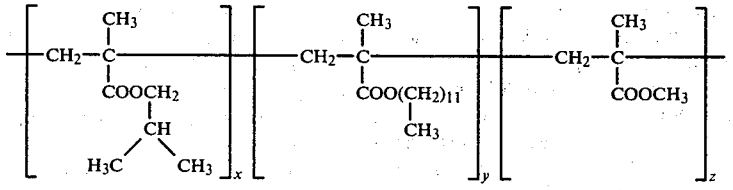

wherein:

x=60% by weight
y=30% by weight
z=10% by weight 480 g of isobutyl methacrylate, 240 g of lauryl methacrylate, and 80 g of methyl methacrylate were added to 4 g of azo-bis-isobutyronitrile and 600 g of distilled 2-methyl ethyl ketone in a 5 liter reaction flask. The resulting solution was heated to 75° C. with stirring whilst nitrogen was introduced. The viscosity of the solution gradually increased. After a reaction of 16 h a supplementary amount of 4 g of azo-bis-isobutyronitrile was added and the temperature of the reaction flask was kept at 75° C. for another 8 h. After the polymerization the viscous polymer solution was cooled to room temperature and 3 l of methanol were added with stirring.

A sticky residue precipitated and the liquid phase was removed. Subsequently, the copoly(isobutyl methacrylate/n-lauryl methacrylate/methyl methacrylate) was washed again in 3 l of fresh methanol and stirred for 1 h at room temperature. Finally, the shapeless polymer mass was dissolved in 3 l of ISOPAR G (trade name of Esso Standard Oil Company for an aliphatic hydrocarbon solvent having a boiling range of 160°-175° C. and a Kauri-Butanol value of 27) with heating, the methanol phase having been decanted first.

The remaining methanol was removed from this solution by evaporation at reduced pressure (water jet pump) and heating between 50° and 80° C. The bright solution was diluted with ISOPAR G (trade name) so as to obtain a solution of 4 kg with 19.76 g of polymer per 100 g of solution.

Yield: 780 g.

Viscosity of a 10% by weight solution in ISOPAR G (trade name) at 25° C.: 6.9 cP.

Intrinsic viscosity [$\eta$] in ISOPAR G (trade name) at 25° C.: 0.057 dl $g^{-1}$.

intrinsic viscosity [$\eta$] in butanone at 25° C. after isolation and drying to constant weight: 0.222 dl $g^{-1}$.

Tg (glass transition temperature) measured by constant heating stream thermal analysis (see E. Steffens, J. Appl. Polymer Sci., 12, 2317-2324 (1968)) was 46° C.

Resistance to abrasion at 20° C.: 500 g.

2. Preparation of copoly(isobutyl methacrylate/n-lauryl methacrylate/vinyltoluene) having the following structure

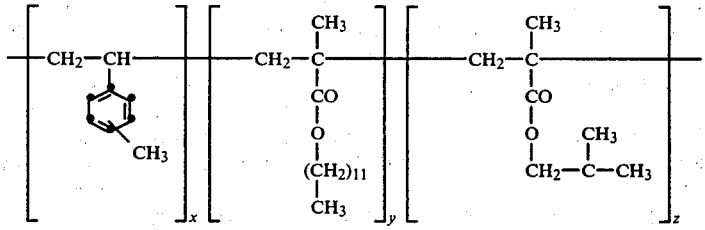

wherein:

x=30% by weight
y=20% by weight
z=50% by weight

Its preparation proceeded in an analogous way as described for the copolymer of preparation 1. The following reagents were used:

| | |
|---|---|
| vinyltoluene | 45 g |
| isobutyl methacrylate | 75 g |
| n-lauryl methacrylate | 30 g |
| 100% benzoyl peroxide | 0.75 g |

-continued

| | |
|---|---|
| ISOPAR G (trade name) distilled under nitrogen | 75 g |

After a reaction time of 8 h a second batch of 0.75 g of 100% benzoyl peroxide was added.

After polymerization the polymer solution obtained could be used as such as fixing composition or collected and finished as described in the preparation of the copolymer of preparation 1.

Properties of the polymer:

Viscosity of a 10% by weight solution in ISOPAR G (trade name) at 25° C.: 14.5 cP.

Intrisic viscosity [$\eta$] in butanone at 25° C. (after isolation and drying): 0.33 dl $g^{-1}$.

Resistance to abrasion at 20° C.: 450 g.

3. Preparation of a copoly(isobutyl methacrylate/vinyltoluene/n-dodecyl methacrylate)

A solution of 20.0 g of m-, p-vinyltoluene (mainly para-), 20.0 g of isobutyl methacrylate, 10 g of n-dodecyl methacrylate, 0.25 g of benzoyl peroxide (100%), and 25.0 g of isododecane or ISOPAR G (trade name) was introduced in a reaction pressure tube of about 100 ml. Nitrogen was bubbled through for 5 min. The pressure tube was sealed and immersed in an oil-bath of 80° C. After a reaction time of 16 h the viscous bright solution was admixed with 0.25 g of benzoyl peroxide and the pressure tube was sealed again and heated to 80° C. After a total reaction time of 40 h a very viscous transparent solution was obtained. The polymerization was quantitative and the polymer solution was diluted with fresh isododecane to a total weight of 250 g.

Yield: 250 g of solution with 20.0 g of polymer per 100 g of solution.

A film of this solution on a glass plate is transparent after drying and non-tacky at room temperature. The resistance to abrasion of the resulting layer at 20° C. is 400 g.

4. Preparation of copoly(isobutyl methacrylate/n-heptyl methacrylate)

32.5 g of isobutyl methacrylate, 17.5 g of n-heptyl methacrylate and 0.25 g of benzoyl peroxide were dissolved in 25.0 g of isododecane in a reaction flask. The solution was heated to 80° C. under a nitrogen atmosphere, stirred, and kept at this temperature for 40 h. Gradually the solution became very viscous. After a total reaction time of 16 h a further amount of 0.25 g of benzoyl peroxide was added. The polymerization is quantitative and after dilution with fresh dodecane or ISOPAR G (trade name) a solution of 250 g was obtained with 20.0 g of polymer per 100 g of solution. The resulting solution can be used as such.

A film of this solution on a glass plate is transparent after drying and non-tacky at room temperature.

The resistance to abrasion of this layer at 20° C. is 400 g.

5. Preparation of copoly(isobutyl methacrylate/hexadecyl acrylate/methyl methacrylate)

This copolymer was prepared from
hexadecyl acrylate: 15.0 g
isobutyl methacrylate: 30.0 g
methyl methacrylate: 5.0 g
ISOPAR G (trade name): 50.0 g
one single addition of 0.25 g of benzoyl peroxide.

After reaction a solution of 200 g was obtained with 25.1 g of polymer per 100 g of solution.

A film of this solution on a glass plate is transparent after drying and non-tacky at room temperature. p The resistance to abrasion of this layer at 20° C. is 300 g.

The determination of the resistance to abrasion is carried out by means of an apparatus by which the resistance to abrasion of gelatin layers is determined. However, the common metal ball is replaced by a metal needle having a diameter of 2 mm and a cylindrically ground tip.

The needle is pushed to and fro twice and as soon as the first abrasion, however small it may be, is perceivable through the layer, the weight is noted.

The degree of resistance to abrasion of the layer applied to a glass support is expressed by the weight in gram with which the needle has been charged to form a scratch in the dry film layer at room temperature (20° C.).

The carrier liquid and likewise the hydrocarbon liquid of the fixing composition preferably mainly include aliphatic hydrocarbons that are liquid at room temperature (20° C.) and have at least 6 carbon atoms, such as e.g. hexane, heptane, octane, decane, dodecane including all the isomers of said compounds, e.g. cyclohexane, and mixtures thereof.

The carrier liquid for electrophoretic development contains preferably only minor amounts (less than 10% by weight) of liquid aromatic compounds. The liquid fixing composition mainly (at least 51% by weight) contains aliphatic liquid hydrocarbons but may contin aromatics e.g. when in the fixing composition an amount of 10% by weight of white spirit is used.

The carrier liquid and likewise the hydrocarbon liquid of the fixing composition are preferably commercial petroleum destillates. For example, mixtures of aliphatic hydrocarbons having a boiling point preferably comprised between about 150° C. and about 220° C. such as the ISOPARS G, H, K and L (trade names) of Esso Standard Oil Company and SHELL SOL T (trade name of Shell Oil Company) are used. Particularly good results are obtained with ISOPAR G (trade name). It comprises about 11.8% by weight of $C_9$, about 55.6% by weight of $C_{10}$ and about 31.3% by weight of $C_{12}$ saturated hydrocarbons. Preferred fixing compositions comprise one of the described copolymers in dissolved form in said hydrocarbon liquid in a range between about 2.5% to about 15% by weight.

Although it is desirable to obtain a perfect transparent protective coating sometimes a coating with a more or less mat appearance is preferred. Such is the case for example when the toner is deposited on a transparent resin support that is used as receptor sheet for the formation of electrophotographically or electrographically produced X-ray images. For diagnostic purposes the film is viewed on a light-table or light-box projecting light through the film. A glossy appearance of the protecting coating is to be avoided in these circumstances.

According to a special embodiment of the present invention the protective coating contains finely divided material that counteracts the gloss of the protective layer. Since the matting agent should not substantially affect the detail rendering of the image particularly small matting particles are preferred.

In accordance with a preferred embodiment of the present invention the resin solution for applying the protective coating contains a dispersion of a graft coplymer. A preferred graft copolymer for that purpose has a linear backbone chain formed of a polymer that is soluble in the hydrocarbon liquid. Grafted to the backbone chain are pendant side chains a major proportion of which are insoluble in said hydrocarbon liquid. Preferably, at least about 85% by weight of the pendant polymeric side chains are insoluble in the hydrocarbon liquid.

When the solvent phase consists of hydrocarbons the backbone chain is e.g. a low molecular weight poly(n-butyl methacrylate) or poly(isobutyl methacrylate) e.g. with an intrinsic viscosity [$\eta$] of 0.20 dl.g$^{-1}$ at 20° C. in acetone, low molecular weight polybutadiene, polyisoprene or polyisobutylene (molecular weight below 6,000) copolymers of styrene and butadiene, copolymers of ethylene and vinyl acetate, copolymers of $\alpha$-olefines and N-vinylpyrrolidone, copolymers of vinyl acetate and vinyl laurate, polystyrene having a molecular weight below 1000 (also because higher molecular weight polystyrene is insoluble in hydrocarbons), terpene resins and the homopolymers and copolymers derived from the monomers described under (A), (B) and (C) above, which homopolymers are soluble in hydrocarbon liquids.

The backbone chain is composed preferably of monomers of the group consisting of isobutyl methacrylate, stearyl methacrylate and optionally minor amounts (below 5% by weight) of (meth)acrylic acid. When copolymers containing (meth) acrylic acid are produced the amount of the latter units is small enough to fulfil the requirement of solubility of the backbone polymer in the hydrocarbon solvent.

The pendant side chains are preferably of the group consisting of polymethyl methacrylate, polyacrylonitrile and polystyrene.

In the manufacture of the graft copolymers first a dilute solution of the soluble polymer that forms the backbone chain is prepared by using a liquid hydrocarbon solvent, which becomes the carrier vehicle of the final resin suspension. Next, (a) monomer(s) of the desired pendant side chain polymers is (are) added to the solution along with a free radical initiator.

Suitable catalysts or free radical initiators for use in the graft copolymerization reaction include soluble organic peroxides. The mixture is then heated and reaction occurs thereby forming insoluble graft copolymer particles as a concentrated stable suspension in the hydrocarbon solvent. This suspension is then diluted with the solution of the fixing polymer in the same or same type of hydrocarbon liquid e.g. ISOPAR G (trade name) to obtain the desired concentration. Good results in the counteraction of the gloss in the protective coating are obtained by using said graft copolymer in an amount of about 1 g to about 20 g per liter of fixing composition.

The graft copolymer concentration is, of course, variable, with a particular concentration being dependent upon the results desired.

There is no need in the present graft copolymer suspensions for a dispersing agent. The soluble starting backbone chain of the graft copolymer serves as a suspending agent.

The graft copolymers suited for use according to the present invention may be prepared according to the detailed preparation technique described in the United Kingtom Pat. No. 1,312,776 filed July 25, 1969 by the Applicant. According to that technique the graft copolymer particles are prepared from:

(a) a solution in an inert organic solvent in a concentration of from 15% to 85% by weight of at least one $\alpha,\beta$-ethylenically unsaturated monomer, the polymers of which are insoluble in the inert organic solvent, (b) from 1% to 10% by weight based on the weight of monomer(s) present of a polymer that does not contain ionizable groups and is soluble in said inert organic solvent, and (c) from 0.1% to 5% by weight based on the weight of monomer(s) present of a free radical-forming polymerisation initiator, the polymerization being carried out at a temperature between 30° and 150° C., with continuous stirring until graft copolymers of said monomer(s) and or said non-ionic polymer are obtained. The graft copolymers are insoluble in the inert organic solvent and for the purpose of the present invention have a particle size of from about 0.2 to about 2 $\mu$m.

By heating the reaction medium the dissolved initiator decomposes under the formation of radicals. These radicals react with the dissolved polymer either via a labile hydrogen atom or via a reactive position so as to form macroradicals. These macroradicals, dissolved in the inert organic solvent, encounter either reactive monomers or already growing polymer chains, which are grafted onto the excited positions of the original polymer. In this way graft copolymers are formed.

Depending upon the amount of dissolved backbone polymer and the kind and the amount of monomer in the reaction medium a smaller or larger part of the original backbone polymer is grafted with short polymer side chains. In the "short side chain-graft copolymers" the solubility characteristics of the original backbone polymer are dominating so that these graft copolymers remain in dissolved state in the liquid hydrocarbon solvent.

Likewise depending upon the amount of dissolved backbone polymer in the reaction medium and the kind and amount of monomer in the reaction medium a smaller or larger part of the backbone polymer is grafted with polymer side chains of a length sufficient to have the insolubility characteristics of the side chain polymer dominating in the graft copolymer. The thus obtained graft copolymer because of the insolubility of the side chain polymer in the liquid hydrocarbon solvent forms small particles (beads) in suspension.

A practical example will illustrate this behaviour. In the production of a graft copolymer 10 g of the copoly(isobutyl methacrylate/stearyl methacrylate/methacrylic acid) (75/14.8/0.2% by weight) as backbone polymer and a mixture of 95 g of styrene and 5 g of acrylonitrile as monomers for the side-chain building in ISOPAR G (trade name) were used. After the graft copolymerization one fraction was soluble in ISOPAR G (trade name) and represented 10.8 g of solid material wherein only 2 g of the monomers were grafted on the backbone chain polymer.

Another fraction was insoluble in ISOPAR G (trade name) and represented 99.2 g of solid material in the form of small beads, wherein the other part (about 2 g) of the backbone polymer was retrieved by infrared analysis and gas chromatography.

The grafted polymer chains (pendant chains) consist either of homogeneous chains if originally only one kind of monomer was present, or of heterogeneous chains composed according to the reactivity parameters of the various monomers present. In addition to this graft copolymerization, especially in an advanced stage of the polymerization process, in most cases a polymerization of the monomers present takes place simultaneously.

Finally a dispersion in the hydrocarbon solvent of small polymer particles is obtained in which non-grafted copolymers and grafted polymer backbone chain can be present. Very regular tiny polymer spheres are obtained.

The graft copolymer particles have a glass transition temperature preferably of at least 40° C.

The polymerization initiator forming free radicals on heating is used in an amount preferably comprised between 0.1 and 5% by weight based on the monomer(s) present.

In principle any polymerization initiator known in the art and forming free radicals upon heating may be used, such as organic peroxides, e.g. benzoyl peroxide, methyl ethyl ketone peroxide, cyclohexanone peroxide, di-t-butyl hydroperoxide, lauroyl peroxide, capryloyl peroxide, and diacetyl peroxide, azo compounds such as azo-bis-isobutyronitrile and peroxides such as dialkyl peroxide carbonates such as diisopropyl peroxide carbonate.

The initiators are chosen depending on their temperature of decomposition and the desired temperature of polymerization, but especially depending on the polymer backbone chosen on which grafting will be carried out. For instance, azo-bis-isobutyronitrile, because of its insufficient reactivity cannot be used for grafting on polybutadiene, polyisoprene, copolymers of butadiene or isoprene, polyvinyl chloride and copolymers of vinyl chloride For this purpose more energetic aryl or benzoyl radicals originating from benzoyl peroxide or cumene hydroperoxide are needed.

Taking into account the aforesaid one can use methyl ethyl ketone peroxide or cyclohexanone peroxide for polymerizations at temperatures between 30° and 50° C., benzoyl peroxide and azo-bis-isobutyronitrile for polymerizations at temperatures between 60° and 80° C., and di-t-butyl hydroperoxide for polymerizations carried out above 100° C.

When the above described combination of solvent, monomer for the pendant side-chain building and backbone polymer of the graft copolymer and polymerization-initiator are heated to the decomposition temperature of the initiator with thorough stirring, the formed radicals induce the polymerization of the monomer(s) present.

With certain highly reactive monomers, thus in cases that the graft copolymer particles might grow too large, chain-tranfer agents or polymerization retarders may be added to the graft-copolymerization medium. In this way further polymerization on the particles can be reduced or eliminated so as to obtain a dispersion of graft copolymers of reduced molecular weight and of narrow molecular weight distribution. Suitable chain-transfer agents or retarders are alkyl-mercaptans, allyl compounds such as allyl alcohol and terpene derivatives such as allocimene and myrcene.

Separation of the polymer particles after graft copolymerization is not necessary for the purpose of the present invention.

The preparation of a particularly suitable graft copolymer is presented here for illustrative purposes.

Preparation of graft[methyl methacrylate copoly(isobutyl methacrylate/stearyl methacrylate/methacrylic acid)] in dispersion In a 1 liter reaction flask equipped with a stirrer, a reflux condenser and a thermometer 100.0 g of methyl methacrylate, 10.0 g of Neocryl B 702 (trade name of Polyvinyl Chemie, the Netherlands) for copoly(isobutyl methacrylate/stearyl methacrylate/methacrylic acid) in a weight proportion of 75–85/15–25/0.2–1 respectively and with a molecular weight of approximatively 70,000) and 5.0 g of benzoyl peroxide were dissolved in 400.0 g of ISOPAR G (trade name) and heated with stirring to 80° C. in the presence of nitrogen. A few minutes after the start of the polymerization the bright solution become turbid. The reaction is exothermic and the reagents have to be cooled to keep the temperature at 80° C. Gradually the reaction mass turned milky white.

After a total reaction time of 20 h the dispersion has cooled to room temperature and filtered through a nylon cloth having a mesh width of 50 $\mu m \times 50$ $\mu m$. Yield: 502 g of dispersion with 21.0 g of polymer per 100 g of dispersion.

Beads having an average diameter smaller than 0.5 $\mu m$ were obtained.

The addition of the graft copolymer to the fixing polymer solution makes that the obtained protective layer (fixing layer) is no longer glossy and that occasional tackiness of the fixing layer is reduced.

The solution of the fixing polymer may contain release (anti-friction) agents e.g. liquid silicones and/or chlorinated or fluorinated silicones that provide a particularly well polished surface to the fixing layer.

The present fixing layer composition can be used for fixing any toner image to any kind of hydrophobic or fairly hydrophobic resin film or sheet support. A wide variety of such supports is known e.g. made of cellulose nitrate, cellulose esters e.g. cellulose triacetate, cellulose acetate butyrate, polyvinyl acetal, polystyrene, polymethacrylic acid esters or highly polymeric linear polyesters e.g. polyethylene terephthalate.

These supports being highly transparent for visible light allow the inspection of the toner image with light projected through the image-containing material e.g. on a light table or in a transparency projector (slide projector).

Preferred are the polyethylene terephthalate supports because of their moisture resistance and high mechanical strength obtained e.g. by stretching.

Particularly good fixing (strong adherence of the protective coating) to the support is obtained when the hydrophobic resin supports, preferably polyethylene terephthalate supports, are subbed with a layer directly adherent to the hydrophobic resin support and substantially consisting of a copolymer formed from 45 to 99.5% by weight of at least one of the chlorine-containing monomers vinylidene chloride and vinyl chloride, from 0.5 to 10% by weight of at least an ethylenical unsaturated hydrophilic monomer, and from 0 to 54.5% by weight of at least one other copolymerisable ethylenically unsaturated monomer.

The vinylidene chloride copolymer may be formed from vinylidene chloride and/or vinyl chloride and hydrophilic monomeric units alone in the ratio indicated above. Preferably up to 54.5% by weight of other recurring units, e.g. acrylamide, methacrylamide, acrylic acid ester, methacrylic acid ester, maleic ester and/or N-alkyl-maleimide units, may also be present.

Suitable vinylidene chloride copolymers are e.g.: copoly(vinylidene chloride/N-t-butylacrylamide/n-butyl acrylate/N-vinylpyrrolidone) (70:23:3:4), copoly(vinylidene chloride/N-t-butylacrylamide, n-butyl acrylate-itaconic acid)(70:21:5:4), copoly(vinylidene chloride/N-t-butylacrylamide/itaconic acid) (88:10:2), copoly(vinylidene chloride/n-butylmaleimide/itaconic acid)(90:8:2), copoly(vinyl chloride/vinylidene chloride/methacrylic acid)(65:30:5), copoly(vinylidene chloride/vinyl chloride/itaconic acid)(70:26:4), copoly(vinyl chloride/n-butyl acrylate/itaconic acid)(66:30:4), copoly(vinylidene chloride/n-butyl acrylate/itaconic acid)(80:18:2), copoly (vinylidene chloride/methyl acrylate/itaconic acid) (90:8:2), copoly(vinyl chloride/-vinylidene chloride/N-t-butylacrylamide/itaconic acid) (50:30:18:2).

All the ratios given between brackets in the above-mentioned copolymers are by weight.

These copolymers are only examples of the combinations that can be made with the different monomers.

The different monomers indicated above may be copolymerised according to various methods. For example, the copolymerisation may be conducted in aqueous dispersion containing a catalyst and an activator. Alternatively, polymerization of the monomeric components may occur in bulk without diluent added, or the monomers may be allowed to react in appropriate organic solvent reaction media.

The vinylidene chloride copolymers may be coated on the hydrophobic film base according to any suitable technique, e.g., by dip-coating or immersion of the surfaces of the film into a solution of the coating material. They may also be applied by spray, brush, roller, doctor blade, air brush, or wiping techniques. The thickness of the dried layer may vary between 0.3 and 3 μm preferably.

Various wetting agents e.g. ULTRAVON W (trade name of Ciba-Geigy AG, Basel, Switzerland) for a disodium salt of 2-heptadecyl benzimidazole disulfonic acid having the following structural formula:

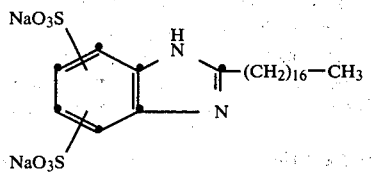

and/or HOSTAPON T (trade name of Farbwerke Hoechst A. G. Frankfurt/M, W. Germany, for oleyl methyl tauride sodium salt) may be used when the vinylidene chloride copolymer layer is applied from an aqueous dispersion. These dispersions are obtained directly when the copolymer has been made by an emulsion polymerization process. When aqueous dispersions of vinylidene chloride copolymer are coated on a polyethylene terephthalate film support, a very strong adherence to the support is obtained when the dispersions are applied before or during stretching of the polyethylene terephthalate film. The aqueous dispersion may be applied to at least one side of the non-stretched film but may also be applied to polyethylene terephthalate film that has been oriented biaxially. The vinylidene chloride copolymer layer may also be coated on at least one side of a polyester film that has been stretched in only one direction, e.g. longitudinally, whereafter the subbed polyester film is stretched in a direction perpendicular thereto, in this case transversally.

The thickness of the subbing layers is not critical and already suffices from about 0.3 μm.

The preparation of said vinylidene chloride copolymers suited for said subbing layer is described, e.g., in the United Kingdom Pat. No. 1,234,755 filed Sept. 28, 1967 by the Applicant.

A subbing layer polymer prepared according to the following preparation recipe yields particularly good adherence to the polyethylene terephthalate support and to the protective layer applied for fixing a toner image according to the present invention.

Preparation of copoly(vinylidene chloride/vinyl chloride/n-butyl acrylate/itaconic acid) (30:50:18:2 by weight)

In an autoclave were placed 1650 ml of water and 9.6 g of itaconic acid. After dissolution a solution of 6 g of sodium hydrogen carbonate in 120 ml of water was added. Subsequently, 98 ml of a 10% aqueous solution of the disodium salt of disulphonated dodecyl diphenyl ether and 49 ml of a 10% aqueous solution of the sodium salt of sulphonated dodecylbenzene were added as emulsifying agents. Then 96 g of n-butyl acrylate, 144 g of vinylidene chloride, 9.8 g of ammonium persulphate, and 4.9 g of potassium metabisulphite were added. The autoclave was sealed and stirring started. Under nitrogen pressure 240 g of vinyl chloride were pressed into the autoclave, which was then heated to 50° C. with stirring. After this temperature had been reached stirring was continued for 15 to 30 min. The temperature of the latex rose to about 65° C. The reaction was continued for about 3 h whereupon the latex was cooled to room temperature. The pH thereof amounted to 2.6 and was adjusted to 6 by means of 100 ml of 1 N aqueous sodium hydroxide. The latex was readily filtrable and contained the copolymer in a concentration of 20%.

The application of said subbing layer copolymer preferably proceeds to an extruded polyethylene terephthalate film, which had been stretched longitudinally up to three times its original length. The subbing layer is applied e.g. in a ratio of about 2 g/sq.m from an aqueous suspension containing:

20% by weight of latex of copoly(vinylidene chloride/vinyl chloride/n-butyl acrylate/itaconic acid) (30:50:18:2 by weight) manufactured as above The film coated in this way is then stretched transversely up to three times its original width.

In electrophotography electrostatic charge patterns are produced on a photoconductive recording member. In "indirect" electrophotography the toner image is formed on a photoconductive recording member, e.g. a selenium-coated drum, and transferred to a non-photoconductive receiving material, e.g. plain paper or transparent resin sheet, onto which the toner image may be fixed according to the process of the present invention.

In "direct" electrophotography the toner image is formed and fixed on the photoconductive recording member, which may be a transparent hydrophobic organic photoconductive layer applied to a transparent conductive interlayer that is carried by a transparent resin base. The fixing of the toner image may proceed on said photoconductive layer according to the process of the present invention.

In electrographic systems an electrostatic charge pattern is produced by information-wise applying electric charge carriers, e.g. electrons and/or ions, onto an electrically insulating surface. For example electrography an electrostatic charge pattern in built up by image-wise modulated corona-charging, information-wise modulated charge deposition with a conductor, e.g. a conductive stylus or pinmatrix, or with an information-wise modulated electron beam.

A survey of electrographic recording techniques is given by R. M. Schaffert in the book mentioned above.

A special type of producing electrostatic charge patterns is based on photo-emission of charged particles.

Processes in which the electrostatic image formation is based on photo-electron emission are described, e.g., in the U.S. Pat. No. 2,221,776 of Chester F. Carlson issued Nov. 19, 1940, the United Kingdrom Pat. No. 778,330 filed Apr. 15, 1955 by C^ie Francaise Thomson-Houston, the German Pat. No. 1,497,093 filed Nov. 8, 1962 by Siemens A. G., the U.S. Pat. No. 3,526,767 of Walter Roth and Alex F. Jvirblis issued Sept. 1, 1970, the published German Patent Applications Nos. 2,231,954 filed June 29, 1972 by Diagnostic Instruments and 2,233,538 filed July 7, 1972 by Diagnostic Instruments, the U.S. Pat. Nos. 2,692,948 of Kurt S.Sion issued Oct. 26, 1954, 2,900,515 of Edward L. Criscuolo and Donald T. O'Conner issued Aug. 18, 1959 and 3,057,997 of Edward K. Kaprelian issued Oct. 9, 1962. Except for the processes described in the latter three patents the photo-electron emission proceeds with a solid photocathode.

A particularly interesting recording technique is known as ionography in which the formation of the electrostatic charge pattern proceeds through the information-wise ionization of photo-ionizable gas as described e.g. in the Belgian Pat. No. 792,334 filed Dec. 6, 1972 by Konics Inc. According to that process an electrostatic charge pattern is formed on a dielectric sheet in an imaging chamber, which comprises between electrodes an interspace filled with a gas having an atomic number of at least 36, e.g. xenon, which is kept at a pressure above atmospheric pressure. During the image-wise X-ray exposure a potential difference is applied between the electrodes and electrons and positive ions formed in said interspace are attracted and move towards the anode and cathode respectively whereby a charge pattern is formed with one of the types of charged particles on the dielectric sheet.

The recording materials applied in X-ray recording are preferably visible light-transparent and smooth resin films or sheets, which give rise to the above explained problem with regard to toner adherence. The fixing composition and method of fixing the toner image according to the present invention offer a particular interesting advantage in the use of said transparent film or sheets.

In order to prevent the deposited charge pattern to fade away after its deposition, the rear side of the transparent charge-receiving material is provided with a transparent electroconductive layer that makes contact with an electrode of opposite charge sign with respect to the deposited charge pattern.

In order to offer a good adherence of the conductive layer to the transparent hydrophobic resin support a subbing layer of the above-described type is used. Suitable transparent conductive layers are essentially composed of polyionic resins, e.g. CALGON CONDUCTIVE POLYMER 261 (trade name of Calgon Inc., Pittsburgh, Pa., U.S.A.) containing 39.1% by weight of active conductive solids, which contain a conductive polymer having recurring units of the following type:

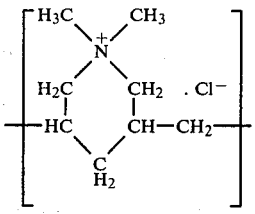

and the polyionic resins described in the United Kingdom Pat. No. 1,301,661 filed Jan. 29, 1969 by the Applicant, or in the published German Patent Applications (DOS) Nos. P 2301266 filed Jan. 11, 1973 and P 2326413 filed May 24, 1973 both by Agfa-Gevaert AG.

Other conductive coatings are e.g. vapour-deposited films of chromium or nickel-chromium about 3.5 μm thick and being transparent for about 65 to 70% in the visible range.

Copper(I) iodide conducting films or sheets can be made by vacuum-depositing copper on relatively thick resin base and a subsequently treating with iodine vapour under controlled conditions (see J. Electrochem. Soc., 110–119, February 1963). Such films are over 90% transparent and have surface resistivities as low as 1500 ohms per square.

The pigment or colouring agent used as toner for the toner image to be fixed may be any of the pigments and dyestuffs commonly employed.

Preferably used toners in conjunction with the fixing method of the present invention contain a polymer essentially consisting of acrylic acid esters and/or methacrylic acid esters.

Suitable toner compositions for electrophoretic development are described e.g. in the United Kingdom Pat. Nos. 1,151,141 filed Feb. 4, 1966 by Gevaert-Agfa N.V. and 1,312,776 mentioned already before, in the published German Patent Applications (DOS) Nos. P 2,334,353 filed July 6, 1973 by Agfa-Gevaert AG and P 2,333,850 filed July 3, 1973 by Agfa-Gevaert AG, and in the United Kingdom Pat. No. 1,316,884 filed Aug. 27, 1970 by Kodak Ltd., which patent relates to a method for protecting photographic images with a graft copolymer composition that is deposited in the form of a fixing layer by applying an electrical potential between an electrode being in closely spaced relationship with the toner image-bearing surface, and an electrically conductive backing layer.

The application of the fixing composition according to the present invention proceeds by known liquid coating techniques that effect no mechanical rubbing on the toner image. Thus, e.g., the application of the liquid fixing composition proceeds by means of a technique known as bead or meniscus coating wherein the fixing liquid is taken up in the form of a bead from a tray and uniformly applied to the whole toner image carrying-surface, the toner image carrying material being guided at its rear side with a roller.

Other suitable coating techniques known to those skilled in the art are spray coating, whirl coating, dip coating, air-knife coating, and trailing blade coating.

The coating is effected preferably in such a way that the coverage of dry solids in the fixing layer is in the range of about 1 g to 10 g of solids per sq.m.

The present invention includes the following Example without, however, limiting it thereto.

EXAMPLE

To one side of a non-stretched polyethylene terephthalate film of 0.8 mm thickness a subbing layer was applied at 25° C. at a coverage of 5 g/sq.m from a latex containing 20% by weight of copoly(vinylidene chloride/vinyl chloride/n-butyl acrylate/itaconic acid) (30:50:18:2 by weight), the preparation of which has been described hereinbefore.

This subbed film was simultaneously stretched longitudinally and transversally to about 10 times its original size.

The subbed film was image-wise electrostatically charged with a negative corona directed to the subbing layer through image-wise distributed apertures in a copper plate, the rear side of the film during the charging being held in contact with a copper plate. The corona charge was of such an intensity that the average voltage of the charge applied to the subbed layer was −300 V.

The charge pattern was developed with an electrophoretic developer prepared as follows.

The following ingredients were ground in a ball mill for 12 h:

12 g of a 25% by weight solution of NEOCRYL B 702 (trade name for a copoly(butyl methacrylate/stearyl methacrylate) comprising 1% by weight of methacrylic acid marketed by Polyvinylchemie, the Netherlands) in ISOPAR G (trade name)

2 g of carbon black MM 2745 (marketed by Arichemie, W. Germany)

10 ml of a 0.2% by weight solution in ISOPAR G (trade name) of the zinc salt of mono-2-butyloctyl phosphate, and 25 ml of ISOPAR G (trade name).

From the above concentrated liquid toner composition 4 ml was diluted with 1 l of ISOPAR G (trade name), whereupon 0.5 ml of a 2% by weight solution of didodecylamine in ISOPAR G (trade name) was added to form an electrophoretic developer composition containing positively charged toner particles.

The image-wise corona-charged material was developed with said electrophoretic developer in a tray, whose conductive walls were connected to the ground.

The developed material containing a toner image was dried in a hot air-stream and dip-coated with a fixing layer from a composition consisting of a 5% by weight solution in ISOPAR G (trade name) of copoly(isobutyl methacrylate/n-lauryl-methacrylate/methyl methacrylate) prepared as described under Preparation 1.

The coated film was dried at 80° C. by guiding it in front of an electric heating element.

The dried fixing layer contained 5 g of solids per sq.m. The adherence and resistance to abrasion of the protective fixing layer were very good.

The layer showed no finger prints when manipulated below 40° C.

We claim:

1. A method of protecting a toner particle image deposited on a resin-containing material surface by electrophoretic development with an electrophoretic developing composition comprising toner particles dispersed in a hydrocarbon insulating liquid, which method comprises applying to the surface carrying the toner particle image immediately after said development and while said image is still wet with said hydrocarbon insulating liquid, a liquid fixing composition in which the liquid is a hydrocarbon liquid which is miscible with the hydrocarbon liquid of said electrophoretic developing composition and consisting essentially of (a) at least one liquid aliphatic hydrocarbon and (b) a film-forming copolymer, said copolymer being dissolved in said hydrocarbon liquid and being derived from:

(A) about 50–90% by weight of at least one monomer of the group consisting of $C_1$–$C_5$ aliphatic esters of methacrylic acid and vinyltoluene, (B) about 10–50% by weight of at least one monomer of the group consisting of $C_7$–$C_{24}$ aliphatic esters of methacrylic acid or acrylic acid and (C) about 0–20% by weight of at least one monomer of the group consisting of $C_1$–$C_5$ aliphatic esters of acrylic acid and vinyl esters of $C_1$–$C_{10}$ aliphatic acids, the amount of said monomer (B) and of said monomer (C) if any being sufficient to render said copolymer soluble in the amount of at least about 2 g/100 ml at a temperature of about 20°–40° C. in the hydrocarbon liquid of said fixing composition.

2. A method according to claim 1, wherein the monomers (A) belong to the group consisting of methyl methacrylate, isobutyl methacrylate, n-butyl methacrylate, and vinyltoluene, the monomers (B) belong to the group consisting of lauryl methacrylate, helptyl methacrylate, docosyl acrylate and tetracosyl acrylate, and the monomers (C) belong to the group consisting of ethyl acrylate, butyl acrylate and a vinyl ester of versatic acid.

3. A method according to claim 1, wherein the liquid comprises at least one hydrocarbon selected from the group consisting of paraffinic, isoparaffinic, and cycloaliphatic hydrocarbons.

4. A method according to claim 3, wherein the liquid hydrocarbons have a boiling point comprised between about 150° C. and about 220° C.

5. A method according to claim 1, wherein the liquid also contains graft copolymer particles in dispersed state.

6. A method according to claim 5, wherein the graft copolymer has a liner backbone chain formed of a polymer that is soluble in said liquid hydrocarbon and has grafted to the backbone chain pendant side chains that have been produced from monomers being soluble in such hydrocarbon but which on polymerization have formed side chains, the major proportion of which is insoluble in such hydrocarbon.

7. A method according to claim 6, wherein the graft copolymer contains as backbone chain a polymer selected from the group consisting of poly(n-butyl methacrylate), poly(isobutyl methacrylate), low molecular weight polybutadiene, low molecular weight polyisoprene, polyisobutylene, copoly(styrene/butadiene), copoly(ethylene/vinyl acetate), copolymers of α-olefines and N-vinylpyrrolidone, copoly(vinyl acetate/vinyl laurate), copoly(vinyltoluene/n-butyl acrylate), copoly(vinyltoluene/n-butyl methacrylate) and polystyrene having a molecular weight below 1000.

8. A composition for fixing an image electrophoretically deposited from a toner carrier liquid immediately after deposition and while the image is still wet with said carrier liquid, said composition consisting essentially of (a) at least one liquid aliphatic hydrocarbon miscible with said carrier liquid and (b) a film-forming copolymer, said copolymer being dissolved in said hydrocarbon liquid and being derived from:

(A) about 50–90% by weight of at least one monomer of the group consisting of $C_1$–$C_5$ aliphatic esters of methacrylic acid and vinyltoluene, (B) about 10–50% by weight of at least one monomer of the group consisting of $C_7$–$C_{24}$ aliphatic esters of methacrylic acid or acrylic acid, and optionally (C) about 0–20% by weight off at least one monomer of the group consisting of $C_1$–$C_5$ aliphatic esters of acrylic acid and vinyl esters of $C_1$–$C_{10}$ aliphatic acids, the amount of said monomer (B) and of said monomer (C) if any being sufficient to render said copolymer soluble in the amount of at least about 2 g/100 ml at a temperature of about 20°–40° C. in the hydrocarbon liquid of said fixing composition.

9. A liquid according to claim 8, wherein the monomers (A) belong to the group consisting of methyl methacrylate, isobutyl methacrylate, n-butyl methacrylate, and vinyltoluene, the monomers (B) belong to the group consisting of lauryl methacrylate, heptyl methacrylate, docosyl acrylate and tetracosyl acrylate, the monomers (C) belong to the group consisting of ethyl acrylate, butyl acrylate and a vinyl ester of versatic acid.

10. A liquid according to claim 8, wherein the liquid comprises at least one hydrocarbon selected from the group consisting of paraffinic, isoparaffinic, and cycloaliphatic hydrocarbons.

11. A liquid according to claim 8, wherein the liquid hydrocarbons have a boiling point comprises between about 150° C. and about 220° C.

12. A liquid according to claim 8, wherein the liquid also contains graft copolymer particles in dispersed state.

13. A liquid according to claim 12, wherein the graft copolymer has a linear backbone chain formed of a polymer that is soluble in said liquid hydrocarbon and has grafted to the backbone chain pendant side chains that have been produced from monomers being soluble in said hydrocarbon but which on polymerization have formed side chains, the major proportion of which is insoluble in said hydrocarbon.

14. A liquid according to claim 13, wherein the graft copolymer contains as backbone chain a polymer selected from the group consisting of poly(n-butyl methacrylate), poly(isobutyl methacrylate), low molecular weight polybutadiene, low molecular weight polyisoprene, polyisobutylene, copoly(styrene/butadiene), copoly(ethylene/vinyl acetate), copolymers of α-olefines and N-vinylpyrrolidone, copoly(vinyl acetate/vinyl laurate), copoly(vinyltoluene/n-butyl acrylate), copoly(vinyl-toluene/n-butyl methacrylate) and polystyrene having a molecular weight below 1000.

15. A liquid according to claim 12, wherein the graft copolymer is present in an amount of 1 g to 20 g per l.

* * * * *